US008690552B2

(12) United States Patent
Chang et al.

(10) Patent No.: US 8,690,552 B2
(45) Date of Patent: Apr. 8, 2014

(54) COMPACT AND STRENGTHENED ROTOR ASSEMBLY OF A RADIATOR FAN

(75) Inventors: Liang-Sheng Chang, Chu Pei (TW); Tien-Chin Wu, Chu Pei (TW); Sheng-Chi Lei, Chu Pei (TW); Evan Chang, Chu Pei (TW)

(73) Assignee: Forcecon Technology Co., Ltd., Chu Pei, Hsin Chu Hsien (TW)

( * ) Notice: Subject to any disclaimer, the term of this patent is extended or adjusted under 35 U.S.C. 154(b) by 250 days.

(21) Appl. No.: 13/209,667

(22) Filed: Aug. 15, 2011

(65) Prior Publication Data

US 2012/0121389 A1 May 17, 2012

(30) Foreign Application Priority Data

Nov. 15, 2010 (TW) ..... 99222057 U
Nov. 24, 2010 (TW) ..... 99222756 U

(51) Int. Cl.

| | |
|---|---|
| ***F04B 17/00*** | (2006.01) |
| ***F04B 35/04*** | (2006.01) |
| ***F04D 29/44*** | (2006.01) |
| ***F04D 29/54*** | (2006.01) |
| ***F01D 25/00*** | (2006.01) |
| ***F01D 25/16*** | (2006.01) |
| ***F03B 11/00*** | (2006.01) |
| ***F03B 11/06*** | (2006.01) |
| ***F03D 11/00*** | (2006.01) |
| ***F04D 29/04*** | (2006.01) |

(52) U.S. Cl.
USPC ..... 417/423.7; 417/353; 415/205; 415/229

(58) Field of Classification Search
USPC ..... 417/423.12, 323.7, 423.9, 352, 353, 417/423.7, 423.14, 423.15, 424.1, 424.12, 417/424.2; 415/229, 203, 204, 205
See application file for complete search history.

(56) References Cited

U.S. PATENT DOCUMENTS

| | | | | |
|---|---|---|---|---|
| 5,532,534 | A * | 7/1996 | Baker et al. | 310/89 |
| 5,655,882 | A * | 8/1997 | Morgan et al. | 416/204 R |
| 6,072,660 | A * | 6/2000 | Teshima | 360/99.08 |
| 6,196,802 | B1 * | 3/2001 | Matsumoto | 416/229 R |
| 6,307,291 | B1 * | 10/2001 | Iwaki et al. | 310/90 |
| 7,045,919 | B1 * | 5/2006 | Lin | 310/67 R |
| 8,061,140 | B2 * | 11/2011 | Harmon, Sr. | 60/670 |
| 2007/0188034 | A1 * | 8/2007 | Yoshida | 310/90 |
| 2007/0252464 | A1 * | 11/2007 | Cheng | 310/156.06 |
| 2008/0218018 | A1 * | 9/2008 | Zhang et al. | 310/90 |
| 2009/0010753 | A1 * | 1/2009 | Xiang | 415/170.1 |
| 2009/0148086 | A1 * | 6/2009 | Kuo et al. | 384/440 |
| 2009/0155055 | A1 * | 6/2009 | Chu | 415/142 |

* cited by examiner

*Primary Examiner* — Devon Kramer
*Assistant Examiner* — Lilya Pekarskaya
(74) *Attorney, Agent, or Firm* — Egbert Law Offices, PLLC

(57) ABSTRACT

A compact, strengthened rotor assembly of a radiator fan, the radiator fan having a baseplate, a stator assembly, a rotor assembly and a reverse axle. The reverse axle is erected at the center of the baseplate or stator assembly and protruded upwards. The rotor assembly has a hub with a top wall and a circumferential wall. A magnetic ring is set annularly into the circumferential wall. Several blades are set annularly onto the exterior of the circumferential wall. A metal sleeve is located at the center of the top wall and protruded downwards. A mating portion is set at the top of the metal sleeve for mating with the top wall. A holding portion is formed within the metal sleeve for assembly and positioning of a bearing, and the bearing is used for pivoting of the reverse axle. The thickness of the top wall ranges between 0.2 mm and 0.5 mm.

5 Claims, 7 Drawing Sheets

COMPACT AND STRENGTHENED ROTOR ASSEMBLY OF A RADIATOR FAN

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a partial structure of radiator fan, and more particularly to an innovative one which has a rotor assembly structure.

2. Description of Related Art Including Information Disclosed Under 37 CFR 1.97 and 37 CFR 1.98

The radiator fan is structurally designed to comprise generally a baseplate, a stator assembly and a blade rotor assembly. Currently, there is a growing trend wherein compact radiator fans are developed in tune with thin-profile electronic computer products.

However, some problems are often encountered during design and improvement of the radiator fan, such as: compactness, structural strength and operating stability. The present invention is particularly intended for improving the structure of conventional radiator fan's rotor assembly to realize desired compactness. For instance, as illustrated in ROC's patent No.: M264562 "radiator fan", the blade rotor assembly disclosed in FIG. 2 is of a typical structure, and its hub is made of plastics. A metal axle is located at the center of the top wall of the hub and protruded downwards, allowing for insertion into the bearing block of the stator assembly. However, it is found during actual applications that, due to the very small diameter of the metal axle (only about 1 mm), the mating area of the metal axle and the hub's top wall is extremely small, leading to difficult matching and poorer locating stability of the metal axle. For this reason, the hub's top wall has to be partially thickened for mating of the metal axle (e.g. disclosed in FIG. 2 in aforementioned M264562). In such case, the increased thickness of hub wall becomes a barrier to the compactness design of the radiator fan.

Referring also to FIG. 3 of patent No. M264562, the hub of the blade rotor assembly is made of plastics, and a plastic sleeve is protruded vertically downwards from the center of the hub's top wall, allowing to accommodate an oil bearing. However, it is found during actual applications that, said hub's top wall must be thick enough (over 1 mm) to guarantee the supporting strength and perpendicularity of the plastic sleeve. Then, a thin-profile hub wall cannot be realized, thus hindering the compactness design of the radiator fan.

Moreover, owing to higher center of gravity of the conventional blade rotor assembly, the blade rotor assembly is prone to be located at higher position adjacent to the hub's top wall, leading to more operational vibration, poorer stability and shorter service life of the radiator fan.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The enhanced efficacy of the present invention is as follows:

Based on the unique construction of the present invention, the "compact, strengthened rotor assembly of radiator fan" allows a metal sleeve to be located at the center of the top wall of the hub. As the hub and metal sleeve is made of solid metal materials, and the metal sleeve is provided with a wider annular mating area (in relation to the annular area of the axle), it is easier to realize accurate matching and excellent stability in the manufacturing process. Hence, the designed thickness of the top wall of the hub ranges between 0.2 mm and 0.5 mm, helping to stably and accurately locate the metal sleeve. As such, a compact and high-strength rotor assembly of radiator fan can be designed for ideal applications.

Moreover, based on the fact that the metal sleeve is located at the center of the top wall of the hub and protruded downwards, the center of gravity of the rotor assembly can be further lowered down given bigger mass of the metal sleeve than the plastic sleeve, so the rotor assembly could be operated more stably and smoothly with better applicability.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
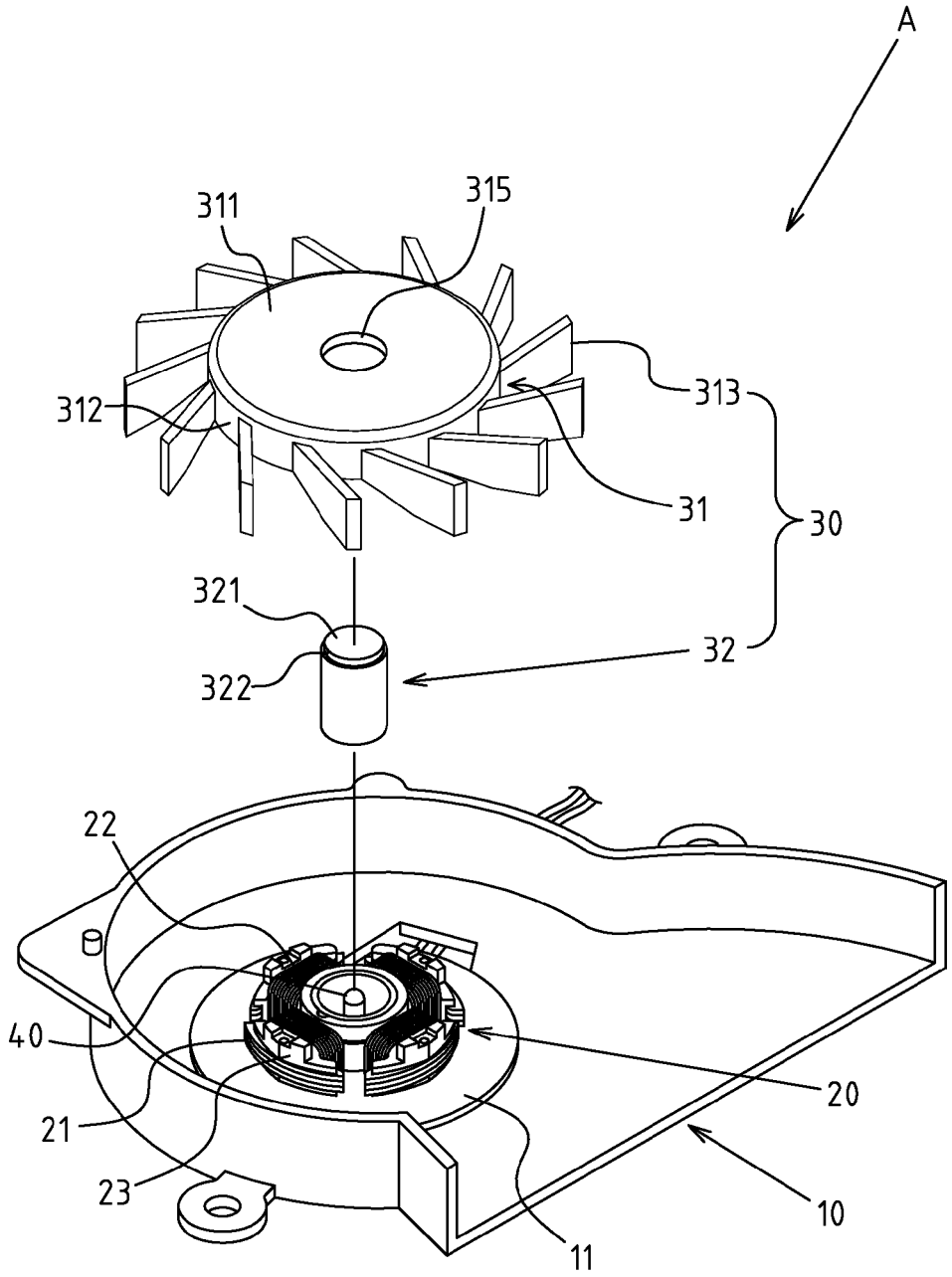
FIG. 1 is an exploded perspective view of the preferred embodiment of the radiator fan of the present invention.
Figure 2:
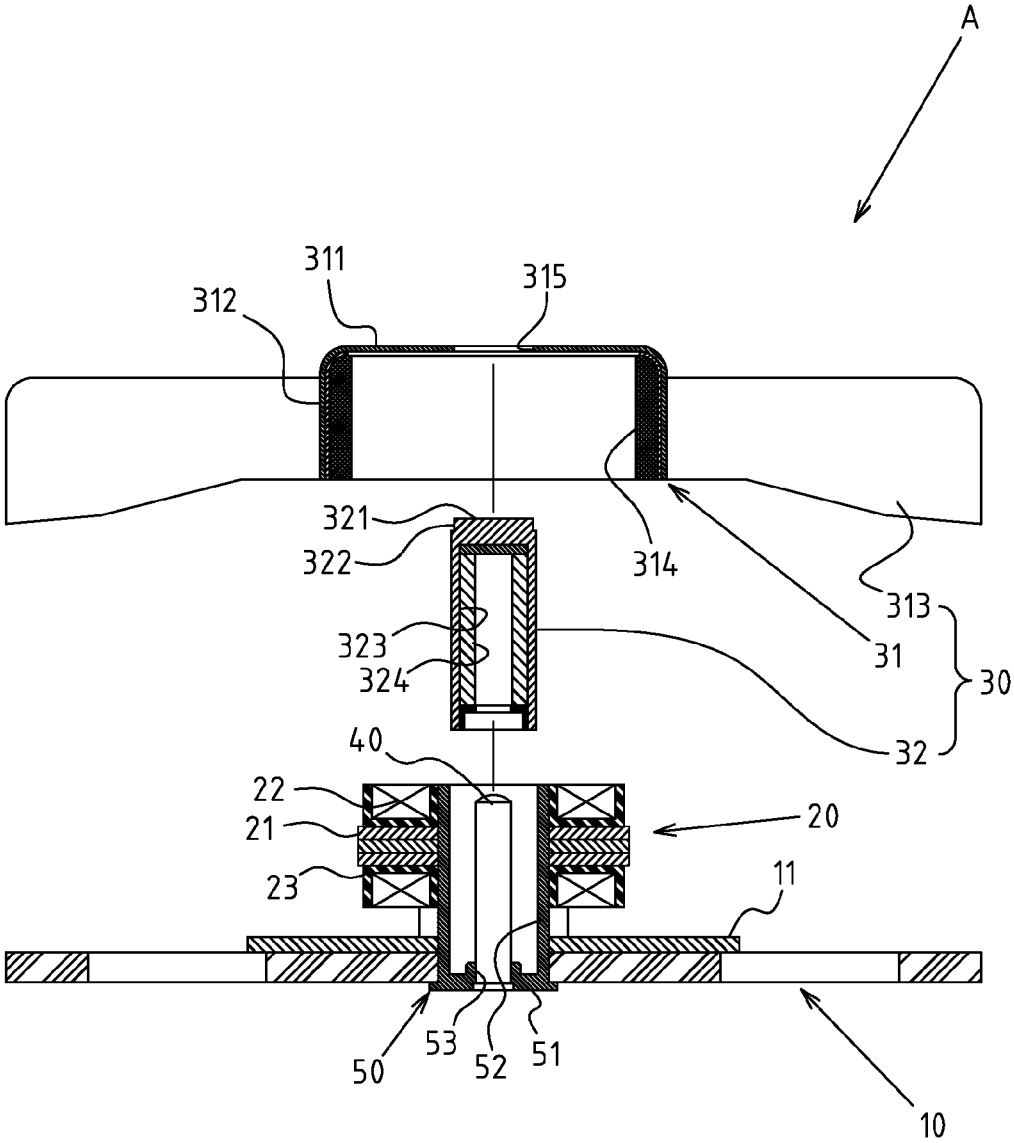
FIG. 2 is an exploded sectional view of the preferred embodiment of the radiator fan of the present invention.
Figure 3:
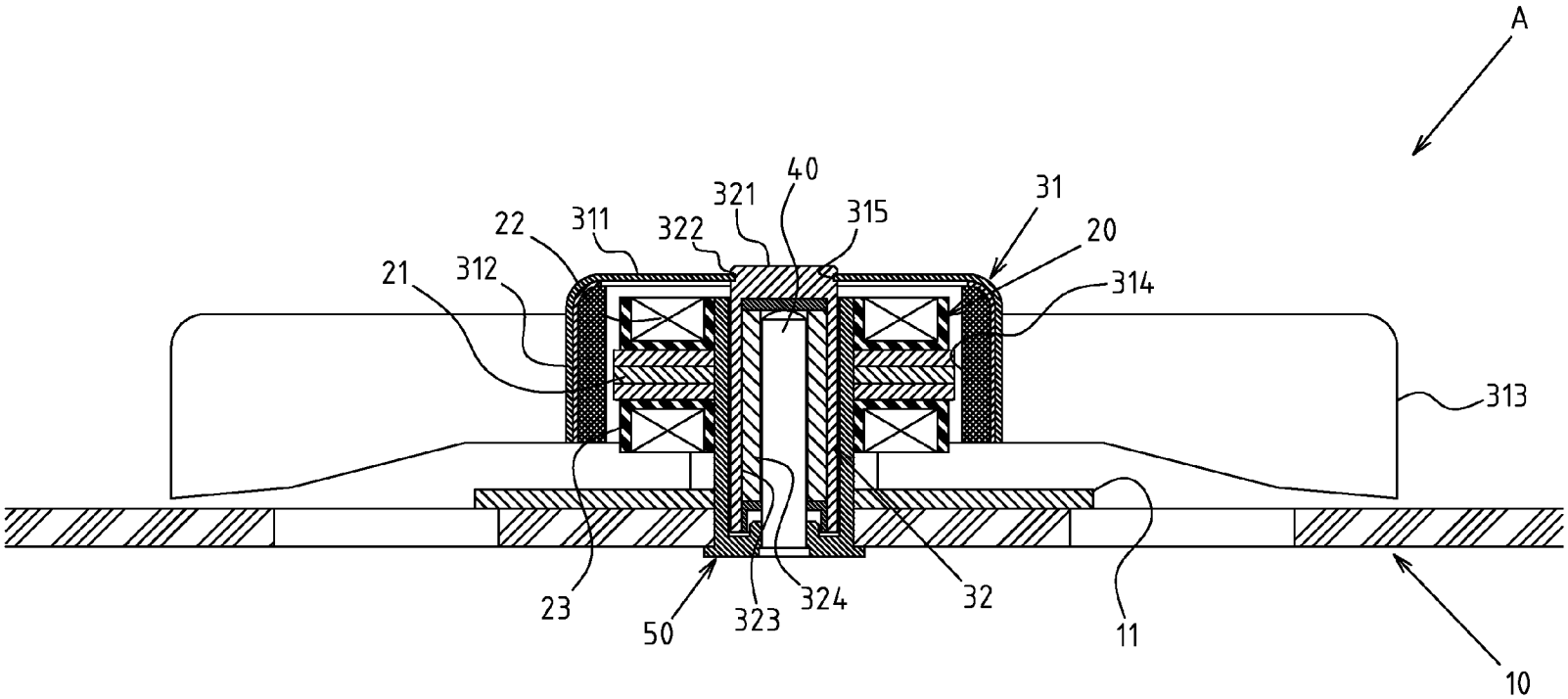
FIG. 3 is an assembled sectional view of the preferred embodiment of the radiator fan of the present invention.

FIGS. 1-3 depict preferred embodiments of a compact, strengthened rotor assembly of radiator fan of the present invention, which, however, are provided for only explanatory objective for patent claims. Said radiator fan A comprises a baseplate 10, a stator assembly 20, a rotor assembly 30 and a reverse axle 40. The stator assembly 20 is assembled onto the baseplate 10, and comprised of a silicon-steel sheet 21, coil 22 and an insulated plastic frame 23. The reverse axle 40 is erected at the center of the baseplate 10 or stator assembly 20 and protruded upwards. A circuit board 11 is set on the baseplate 10

The rotor assembly 30 comprises a hub 31, made of metal or plastic materials, comprising of a top wall 311 and a circumferential wall 312. Of which a magnetic ring 314 is set annularly into the circumferential wall 312.

Several blades 313 are set annularly at interval onto the exterior of the circumferential wall 312. Said blade is made of metal or plastic materials.

A metal sleeve 32 is located at the center of the top wall 311 of the hub 31 and protruded downwards. A mating portion 322 is set at the top 321 of the metal sleeve 32 for mating with the top wall 311 of the hub 31. A holding portion 323 is formed within the metal sleeve 32 for assembly and positioning of a bearing 324, and the bearing 324 is used for pivoting of the reverse axle 40.

Figure 4:
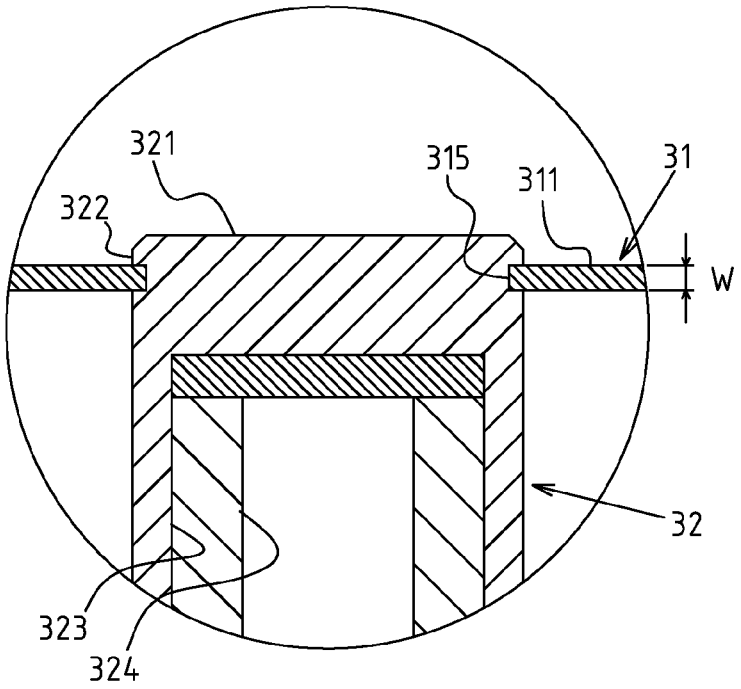
FIG. 4 is an enlarged view of the mating portion at top of the metal sleeve shown in FIG. 3.

Referring to FIG. 4, the hub is made of metal materials, and the thickness (W) of top wall 311 of the hub 31 ranges between 0.2 mm and 0.5 mm.

Of which, the mating portion 322 on the top 321 of the metal sleeve 32 is riveted, such that a punch hole 315 is set on the top wall 311 of the metal hub 31, allowing for riveting of the mating portion 322 on the top of the metal sleeve 32 (shown in FIG. 4).

Of which, the top 321 of the metal sleeve 32 is set into an enclosed pattern.

The metal sleeve 32 is protruded downwards beyond the bottom of the circumferential wall 312 of the hub 31. The center of gravity of the metal sleeve 32 can be further lowered down to an optimum state, so that the rotor assembly 30 could be operated more stably.

Moreover, the bottom of said reverse axle 40 can also be located firmly onto the baseplate 10, or at the center of the stator assembly 20. As disclosed in FIG. 2, a metal axle base 50 (made of copper) is fixed at the bottom of the insulated plastic frame 23 of the stator assembly 20, and also designed like a cup to comprise a bottom wall 51 and a circumferential wall 52, then located onto the insulated plastic frame 23 from the top of the circumferential wall 52. An axle hole 53 is set at the center of the bottom wall 51 for insertion and positioning of the bottom of the reverse axle 40.

Figure 5:
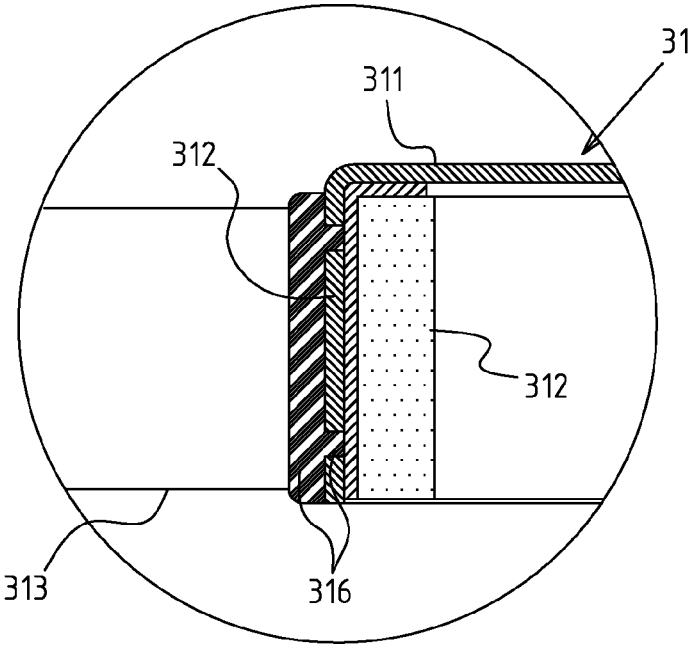
FIG. 5 is a schematic view of the plastic blade of the present invention.

An application view of the plastic blade 313 is also illustrated in FIG. 5, wherein the plastic blade 313 is fixed onto the circumferential wall 312 of the hub 31 by means of injection coating, such that a coating& mating portion 316 is arranged between the plastic blade 313 and circumferential wall 312 of the hub 31, so as to couple firmly the plastic and metal materials.

Figure 6:
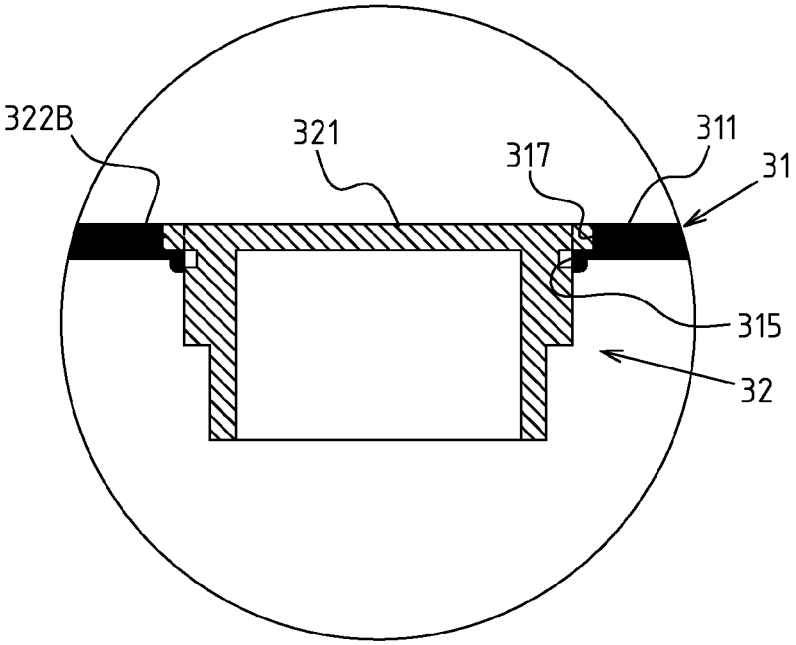
FIG. 6 is another schematic sectional view of the mating portion at top of the metal sleeve.
Figure 7:
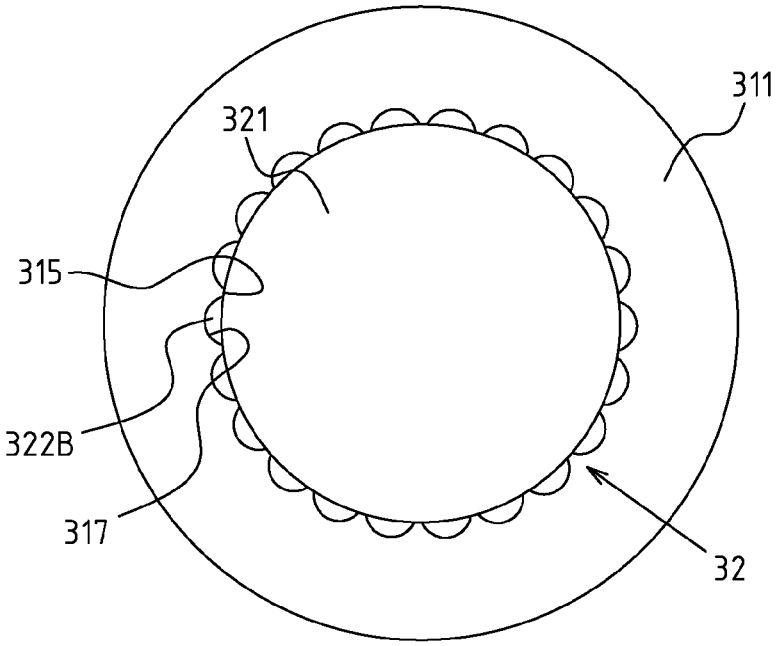
FIG. 7 is a plan top view of the top of metal sleeve disclosed in the preferred embodiment in FIG. 6.

Another application view of the mating portion 322B at top 321 of the metal sleeve 32 is illustrated in FIGS. 6 and 7, wherein the mating portion 322B of the metal sleeve 32 is composed of flanges arranged annularly at interval, such that toothed edges 317 are formed annularly at interval in relation to the punch hole 315 on the top wall 311 of the hub 31, and meshed tightly with the mating portion 322B for more reliable assembly and positioning.

Figure 8:
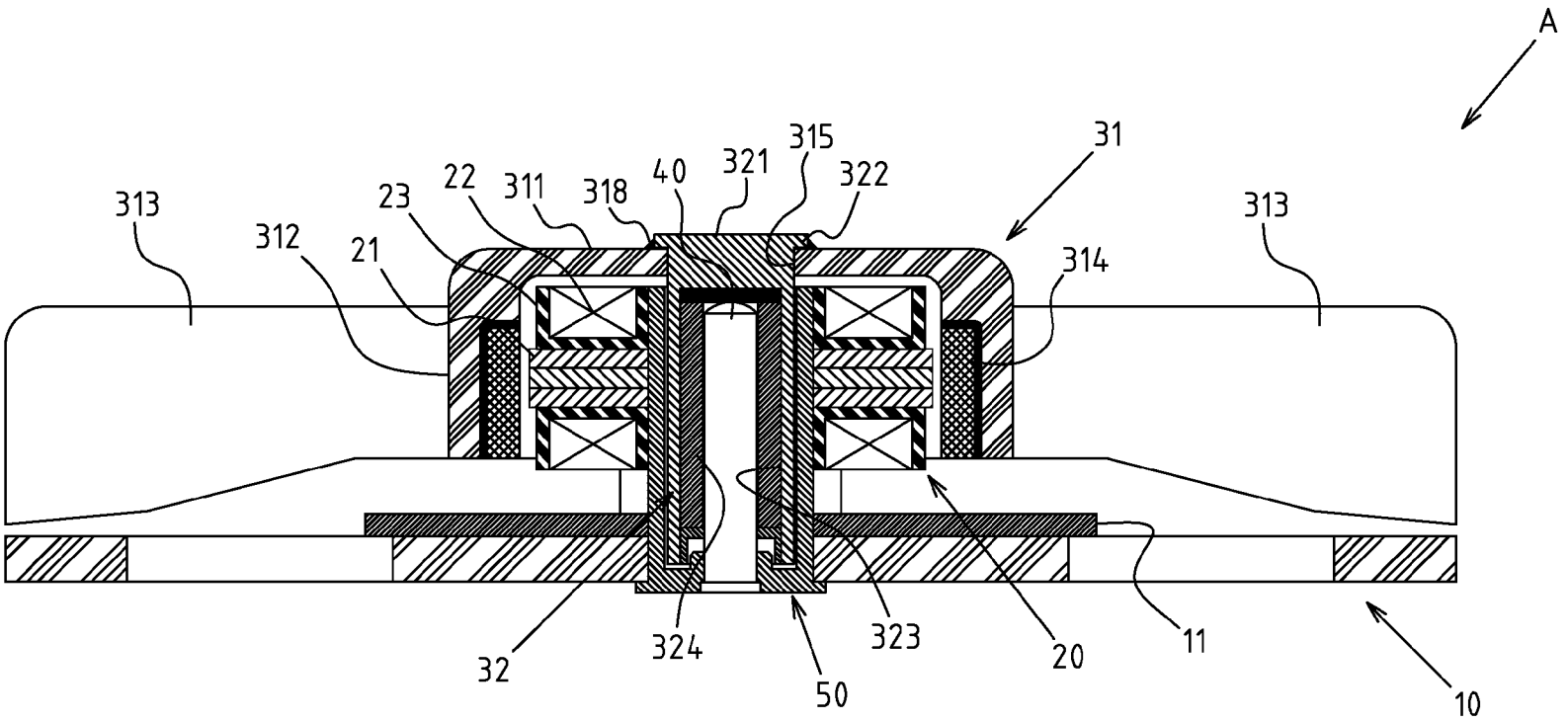
FIG. 8 is an assembled sectional view of the preferred embodiment of the radiator fan of the present invention.
Figure 9:
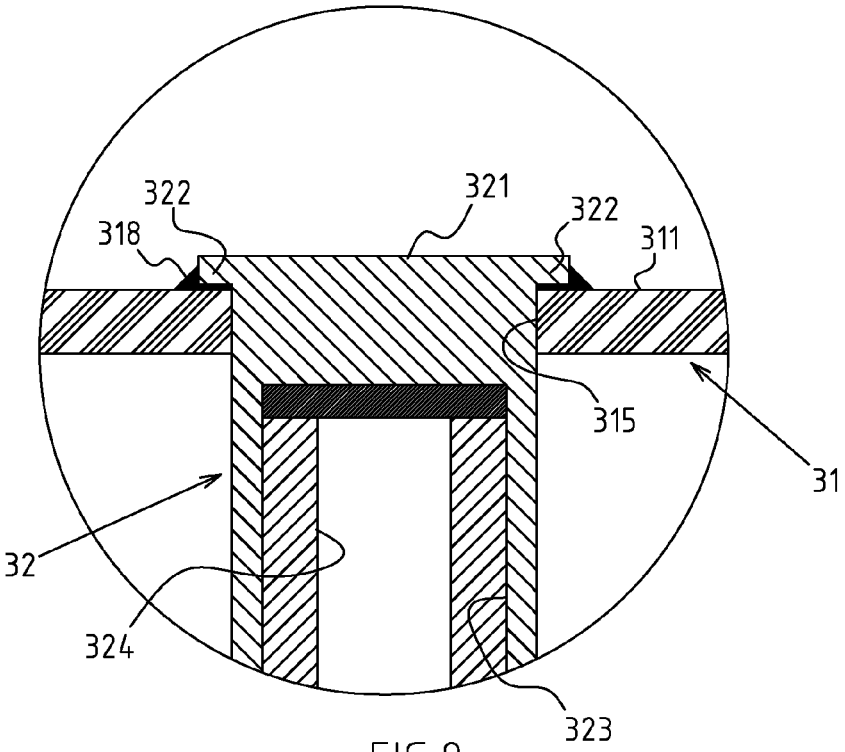
FIG. 9 is an enlarged view of the mating portion of the metal sleeve shown in FIG. 3.

An application view of the plastic hub 31 is illustrated in FIGS. 8 and 9, wherein the mating portion 322 on top 321 of the metal sleeve 32 is designed into a circular flange pattern, such that a punch hole 31 is set at the center of the top wall 311 of the plastic hub 31. The diameter of the punch hole 315 is enough to insert tightly the metal sleeve 32, then the mating portion 322 of a circular flange pattern is abutted onto the top wall 311 of the hub 31. Moreover, the mating portion 322 and the top wall 311 of the hub 31 is fixed by adhesive 318 (shown in FIG. 9).

Figure 10:
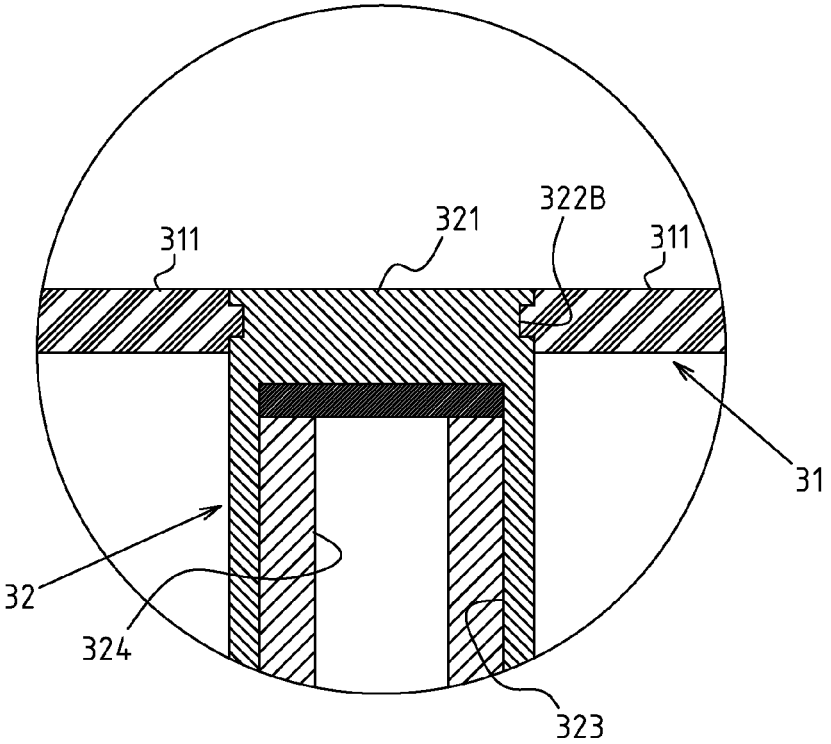
FIG. 10 is a schematic view of the present invention wherein the metal sleeve is embedded by means of injection coating.

Referring also to FIG. 10, the mating portion 322B on top 321 of the metal sleeve 32 also has a circular groove or spaced slot pattern, such that the top wall 311 of the plastic hub 31 is embedded into the mating portion 322B by means of injection coating.

We claim:

1. A radiator assembly comprising:

a base plate;

a stator assembly assembled onto said base plate, said stator assembly having a central area, said stator assembly having an insulated polymeric frame and a coil and a silicon-steel sheet;

a rotor assembly extending around said stator assembly, said rotor assembly comprising:

a hub having a top wall and a circumferential wall extending toward said baseplate from said top wall, said top wall having a punch hole formed centrally thereof and extending therethrough;

a magnetic ring affixed annularly to an inner surface of said circumferential wall of said hub, said magnetic ring being cooperative with said coil of said stator assembly;

a plurality of blades arranged in spaced relation and extending outwardly from said circumferential wall of said hub, each of said plurality of blades being formed of a polymeric or metal material;

a metal sleeve having an upper end affixed within said punch hole of said top wall of said hub so as to have an end extending above said top wall, said metal sleeve extending downwardly from said top wall toward said base plate, said metal sleeve having a mating portion extending circumferential therearound, said mating portion receiving an edge of said punch hole therein, said metal sleeve having a holding portion formed therein; and a bearing affixed within said holding portion of said metal sleeve; and a reversing axle extending upwardly from a center of said baseplate, said reversing axle extend through said central area of said stator extending into said metal sleeve, said bearing interposed between said reversing axle and said metal sleeve.

2. The radiator assembly of claim 1, said hub formed of a metal material, said mating portion of said metal sleeve being riveted to said top wall of said hole.

3. The radiator assembly of claim 1, said upper end of said metal sleeve being enclosed.

4. The radiator assembly of claim 1, said metal sleeve extending downwardly beyond a bottom of said circumferential wall of said hub.

5. The radiator assembly of claim 1, said top wall of said hub having a thickness of between 0.2 mm and 0.5 mm.

* * * * *